United States Patent [19]

Kern et al.

[11] Patent Number: 4,829,858

[45] Date of Patent: May 16, 1989

[54] PLIERS-TYPE HAND TOOL

[75] Inventors: Peter Kern; Gerhard Bayer, both of Stuttgart; Johannes Solf, Sindelfingen, all of Fed. Rep. of Germany

[73] Assignee: SWG Schraubenwerk Gaisbach GmbH & Co. KG, Kunzelsau-Gaisbach, Fed. Rep. of Germany

[21] Appl. No.: 214,923

[22] Filed: Jun. 9, 1988

Related U.S. Application Data

[63] Continuation of Ser. No. 941,394, Dec. 15, 1986, abandoned.

[30] Foreign Application Priority Data

Dec. 20, 1985 [DE] Fed. Rep. of Germany ..... 3545411

[51] Int. Cl.[4] ..... B25B 7/02

[52] U.S. Cl. ..... 81/415; 81/427.5

[58] Field of Search ..... 81/415, 427.5; D8/51-58; 29/278; 7/168; 269/6

[56] References Cited

U.S. PATENT DOCUMENTS 1,882,095 10/1932 Reggitts ..... 81/415

3,776,071 12/1973 Krampe ..... 81/415

FOREIGN PATENT DOCUMENTS 1905784 9/1970 Fed. Rep. of Germany .

1926031 7/1972 Fed. Rep. of Germany .

7525115 12/1975 Fed. Rep. of Germany .

2756705 3/1979 Fed. Rep. of Germany ..... 81/427.5

3019734A1 12/1981 Fed. Rep. of Germany .

3309342 3/1984 Fed. Rep. of Germany .

2215294 8/1974 France .

*Primary Examiner*—Frederick R. Schmidt

*Assistant Examiner*—Maurina Rachuba

*Attorney, Agent, or Firm*—Lackenbach Siegel Marzullo & Aronson

[57] ABSTRACT

In order to ergonomically optimize the hand side of combination pliers, whose gripping arms in each case form a mouth jaw on their ends and are in operative connection by means of a joint in such a way that in the case of different activities with the pliers the adaptation of the gripping arms to the anatomy and anthropometry of the human hand is retained, it is proposed that the gripping arms face one another elliptically in the plane thereof and that in the vicinity of the coupling surface to the hand the gripping arms have an elliptical cross-section.

12 Claims, 3 Drawing Sheets

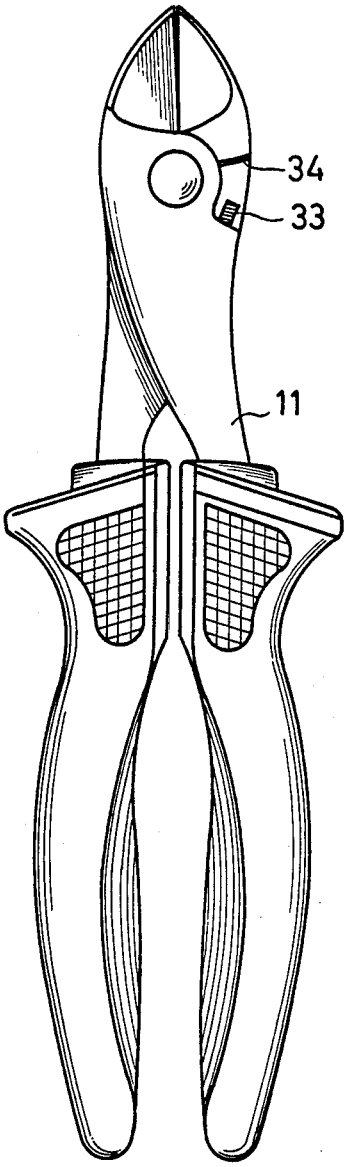
FIG. 6
FIG. 3
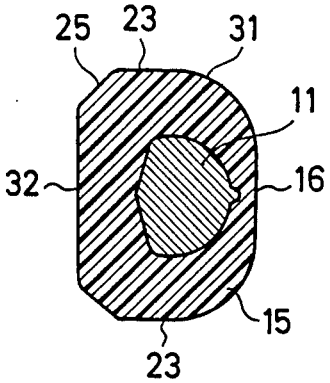
FIG. 5
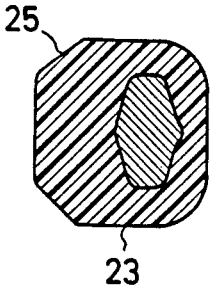
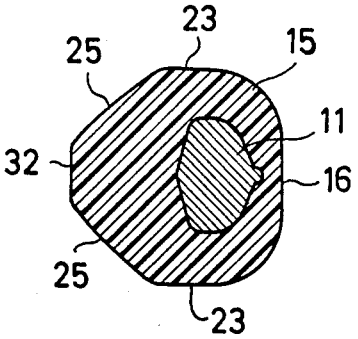
FIG. 4

PLIERS-TYPE HAND TOOL

This application is a continuation of application Ser. No. 941,394, filed Dec. 15, 1986 now abandoned.

The invention relates to a pliers-type hand tool with two arms connected by a joint and which in their end region form mouth jaws, being constructed as gripping arms on the other side of the joint.

A pliers-like hand tool of this type is known (DE-U-75 25 115) and can be in the form of combination pliers, flat-jawed pliers, round-nosed pliers, flat round-nosed pliers, cable pliers, diagonal cutting pliers, etc. In the known tool the sides of the two gripping arms are located in two parallel planes, which means that the gripping arms always have the same width.

Such pliers are used for holding, shaping and separating articles or materials. It is immediately apparent that in the case of shaping and separating activities, greater clamping forces are needed than with holding activities, which must be applied at right angles on the backs of the two gripping arms. Holding and shaping activities require an additional introduction of forces in the direction of the longitudinal and transverse axes of the pliers. In the case of unfavorably shaped gripping arms there can be extreme pressure peaks in the inner hand and finger region.

To advance the work, holding and shaping activities generally require frequent gripping after and round the work object, while the pliers remain in position. This is only possible with difficulty on conventional pliers, because they alter their position in the hand as a result of the gripping conditions on opening the finger joints.

The problem of the invention is to so construct a pliers-type tool, particularly actual pliers, that it has a good position in the hand for different activities and the adaptation of the gripping arms to the anatomy and anthropometry of the human hand is retained.

According to the invention this problem is solved in that the sides of the gripping arms are provided with necked-down depressions in the vicinity of the index finger and thumb position, which are substantially at right angles to the longitudinal axis of the pliers. During the opening process or in the opened state, this makes it possible to hold the pliers on one gripping arm with the thumb and index finger basic joint, without gripping round the same.

According to a further development, the channel-like depressions are not precisely at right angles to the longitudinal axis of the pliers and instead slope under an angle of e.g. 15° to 20° inwards and unwards, i.e. in the direction of the mouth of the pliers. This makes handling even more advantageous, because the slope corresponds to the natural arrangement of the fingers when handling the pliers.

According to a further development, the sides of the gripping arms can diverge slightly in the direction of the mouth of the pliers. For example the two sides of a grip can form an angle of 4° with respect to the longitudinal axis of the grip. According to the invention, the thickest point of the gripping arm can be directly upstream of the starting depression. Due to this divergence of the sides, account is taken of the fact that the index finger which is longer than the little finger has a longer wrap-around surface.

According to the invention the outer contour of the gripping arm is widened outwards between the depression and the joint. This per se known extension not only serves to provide protection against slipping, but in particular ensures a better engagement of the pliers in the joint region between thumb and index finger. The extension can also serve as a toggle-like contact surface, if a rotary movement about the longitudinal axis of the pliers is to be performed.

To permit correct holding of the pliers in the correct position under difficult conditions, e.g. dirty hands or dirty tool, the invention provides profiled gripping zones on the gripping arms in the vicinity of the depression.

The sides can be bevelled in the vicinity of their inner edges directed towards one another. This cross-section, preferably in the form of linear bevel can serve to facilitate the opening of the toool with the tips of the little finger. Preferably the sloping surfaces formed by the bevel are at an angle of approximately 45° with respect to the sides.

To adapt the gripping arms to the inside of the partly closed hand, the outer contour of the gripping arms between the depression and its end follows the shape of an ellipse or an oval. The cross-section through the gripping arms is preferably rounded in an oval or elliptical manner on the outside of said arms.

Further features, details and advantages of the invention can be gathered from the following description of exemplified embodiments relative to the drawings, wherein:

FIGS. 3 to 5 illustrate enlarged cross-sectional view through the gripping arms of the pliers of FIGS. 1 and 2;

FIG. 6 illustrates a plan view corresponding to FIG. 1, but showing diagonal cutting pliers made according to the invention.

Figure 1:
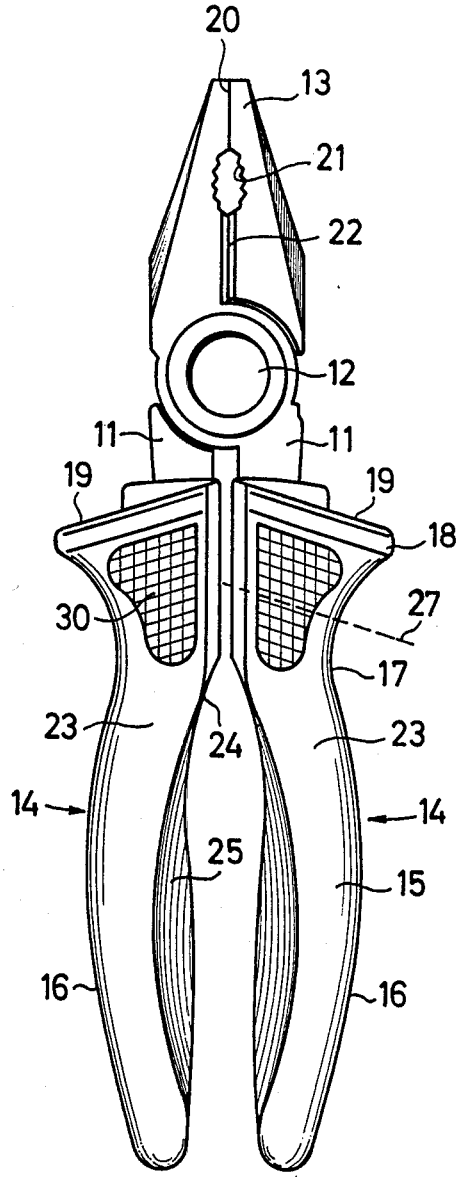
FIG. 1 illustrates a plan view of a combination pliers made according to the invention.
Figure 2:
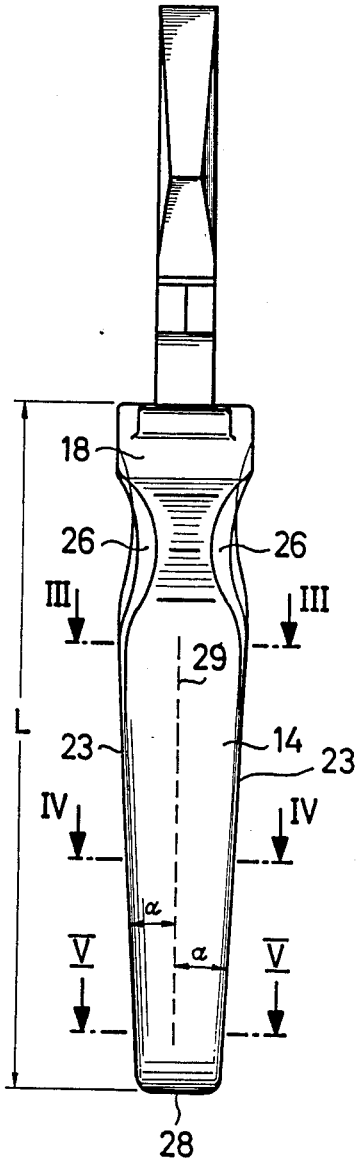
FIG. 2 shows a side view of the pliers shown in FIG. 1.

An embodiment of the tool of the invention is shown by the combination pliers of FIGS. 1 and 2. It has two arms 11, which are interconnected by means of a swivel joint 12. On one side of joint 12, each of the two arms 11 forms a mouth jaw 13, which together form the mouth of the combination pliers. On the opposite side of joint 12, the arms 11 are constructed as gripping arms 14. Each of the gripping arms 14 has a plastic, hand-adapted insulation 15.

In the wide side view, the outer contour 16 is bent convexly outwards, roughly in the nature of the flat side of an ellipse or oval. The major axis of the ellipse runs in the longitudinal axis of the pliers. Starting from the free end of the gripping arms 14, the outer contour 16 thereof is widended and then narrows again. From a minimum width point 17, the outer contour then widens again, so that toggle-like widened portions 18 are formed. In the direction of the mouth of the pliers, widened portions 18 are bounded by a terminating face 19, which slopes linearly to the longitudinal axis under an angle of approximately 15° to 20°. The sloping path is chosen in such a way that the two terminating faces 19 converge from the outside to the inside in the direction of the mouth of the pliers.

In their front region, jaws 13 form two parallel surfaces 20, so that flat-jawed pliers are formed in this area. Following onto the same, there are two ribbed, rounded recesses 21, with the aid of which the combination pliers can embrace and rotate a cylindrical part, e.g. in the same way as water pump pliers. This is followed by a third region, in which the two jaws form cutting edges 22, so that here a type of diagonal cutting pliers is formed.

The sides 23 of the two gripping arms 14 visible in FIG. 1 are bevelled in the vicinity of their facing lonitudinal edges 24, the width of the bevel varying over the length of the gripping arms 14. The bevel forms sloping surfaces 25, which have a slope of approximately 45° with respect to the planar sides 23 of gripping arms 14. These sloping surfaces 25 are intended to aid opening of the finger gripping arm with the finer tips.

Through the roughly elliptically shaped outer contour 16 of gripping arms 14, it is possible to adapt the shape of the latter to the natural curvature of the skeleton of the hand.

As can be gathered from FIG. 2, the sides 29 of the gripping arms 14 have depressions 26 in their region facing the joint 12 of the pliers and these are formed in an approximately channel-like manner with a rounded cross-section. The deepest point of the depression 26 is represented by line 27 shown in FIG. 1. This line 27 and consequently the longitudinal direction of depressions 26 runs parallel to the bounding surfaces 19 of the toggle-like widened portions 18. In other words, in the longitudinal direction, the depressions slope with respect to the longitudinal axis of the pliers and, the depressions 26 of both gripping arms 14 converging from the outside to the inside in the direction of the mouth of the pliers. The divergence of the longitudinal direction is approximately 15° to 20° with respect to a perpendicular on the longitudinal axis of the pliers.

As can be gathered from FIG. 1, line 27, which represents the deepest point of depression 26, intersects the outer contour 16 of gripping arm 14 at right angles. The planar sides 23 of gripping arms 14 diverge from the end 28 of gripping arms 14 in the direction of the mouth of the pliers and in fact said two sides form an angle $\alpha$ of approximately 4° with the longitudinal direction 29 shown in broken line form. As a result of the slight wedge shape of the combination pliers, account is taken of the fact that the index finger which is longer than the little finger has a greater wrap-round surface. The extension of the sides 23 takes place immediately upstream of depression 26, so that the gripping arms 14 have their thickset point immediately upstream of depression 26. However, the boundary of the toggle-like widened portions 18 could be thicker.

Depressions 26 serve to form a bed for the thumb of the front side of the arms, while serving as a bed for the index finger on the back thereof. This ensures that during the gripping after and round, i.e. during the opening process of the four fingers, the pliers are held by being gripped between the index finger basic joint and the thumb end joint. Thus, during the opening and closing process, the pliers are always held in the same position in the hand. In order to ensure these favorable coupling conditions even in the case of disturbing influences, such as dirt, wet, grease, etc., in the vicinity of depressions 26, profiled gripping zones 30 are provided, as shown in FIG. 1. These gripping zones 30 only extend over the front and back surfaces, i.e. in the sides 23 of the arms, but not in the outer contour 16. The total arm length L according to FIG. 2 should not significantly exceed 110 mm. This ensures that a relative orientation of the longitudinal axis of the pliers to the longitudinal axis of the hand is possible. Longer gripping arms can prevent this by restraining the arm end on the little finger ball.

FIG. 3 shows on an enlarged scale a cross-section through a gripping arm 14 roughly along line III—III in FIG. 1. The metal arm of the pliers is completely surrounded by plastic insulation 15, so that the user has a pleasant warm feel. The outer contour 31 of the cross-section passes from the cross-sectioned linear sides 23 in very rounded manner via the again linear outer contour 16 of gripping arm 14 and then again rounded into the second side 23. The cross-sectioned linear sloping surfaces 25 are relatively narrow. The inside 32 is also linear and parallel to outer contour 16.

FIG. 4 shows a cross-section corresponding to FIG. 3 level roughly with the line IV—IV of FIG. 2. At this point the thickness of the gripping arm or insulation 15 is somewhat less, so that there is a smaller distance between sides 23. Sloping surfaces 25 have their greatest width in this area, so that the inside 32 of gripping arm 14 is narrowest.

FIG. 5 shows a cross-section through gripping arm 14 in the vicinity of end 28 roughly along line V—V in FIG. 2. There is a further decrease in the width of sloping surfaces 25, so that the sides 23 again become larger. The thickness of the gripping arm is again smaller.

FIG. 6 shows a wide side view corresponding to FIG. 1 of diagonal cutting pliers. The grip form is unchanged compared with the embodiments of FIGS. 1 to 4, the only difference being in the shape of the arm 11 outside the gripping arm 14 and in the nature of the mouth of the pliers, which is in the conventional form for such diagonal cutting pliers. In a cavity of one gripping arm is screwed a screw 33 with a hexagonal recess, which engages on a mating surface 34 on opening the pliers. This provides a stop surface for the opening movement of the pliers, which can also be adjusted with the aid of a hexagonal spanner.

Figure 7:
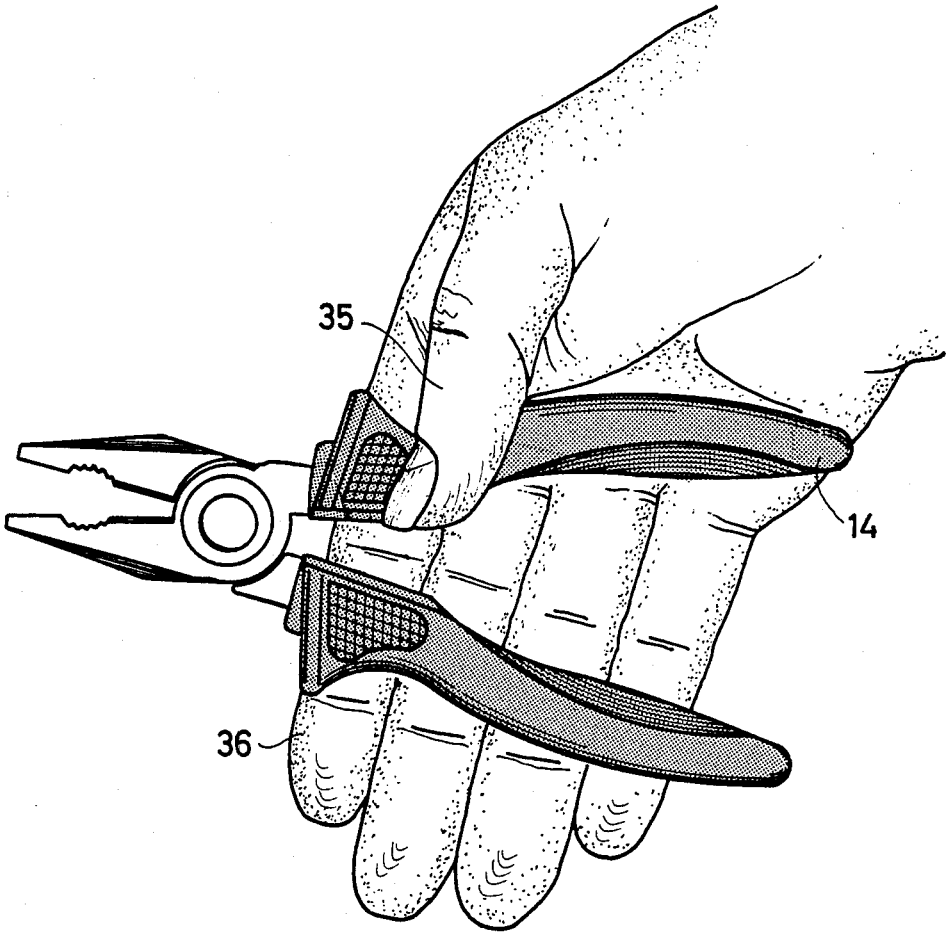
FIG. 7 shows the position of the combination pliers of FIGS. 1 and 2 when held in the hand during use.

FIG. 7 shows how the combination pliers proposed by the invention are held in the hand of a user. It can be seen that the thumb 35 is located in depression 26 on the front of one gripping arm, while the basic joint of index finger 36 is located in depression 26 on the opposite side of the same gripping arm 14. In this position the pliers can be opened and closed without having to be released.

The combination pliers constitute a universal tool usable for numerous purposes. This universal nature is reduced for special uses through different jaw shapes. The gripping arm shape proposed by the invention is also valid for the following jaw cross-sections, while this list does not claim to be definitive: flat, round and flat-bottomed, round half-oval, hollow, pointed, as well as combinations of these jaw cross-sections.

We claim:

1. Pliers-like hand tool having an improved gripping profile in a swivel joint region between thumb and index finger, and having at opposite end regions along the longitudinal axis thereof two arms (11) connected to the swivel joint (12) forming mouth jaws (13) which together form a mouth of said hand tool in one end of said hand tool and forming gripping arms with inner and outer contours, opposite sides, and sloping surfaces on the other end of said hand tool, characterized in that the gripping arms (14) are provided with necked down depressions (30) in the outer contours (16) and sides (23 thereof having longitudinal axes in the vicinity of the index finger and thumb position of the gripping profile, and each side (23) and inner contour of said gripping arm (14) is bevelled so as to form said sloping surfaces at the intersection of said sides (23) with said inner contours of said gripping arms (14).

2. Hand tool according to claim 1, wherein said necked-down depressions run in the longitudinal direction (27) of said hand tool and sloped towards from the outside to the inside in the direction of said mouth of said hand tool.

3. Hand tool according to claim 1, wherein said sides of the gripping arms diverge slightly in the direction of the hand tool mouth.

4. Hand tool according to claims, 1 or 2 wherein said gripping arm (14) have a thickest point just upstream of the start of the depressions (26).

5. Hand tool acccording to claims, 1 or 2 wherein said outer contour (16) of the gripping arms (14) is widened outwards between the depression (26) and the swivel joint (12).

6. Hand tool according to claims, 1 or 2 wherein said sides (23) of the gripping arms (14) have profiled gripping zones (30) in the vicinity of the depressions (26).

7. Hand tool according to claims, 1 or 2 wherein said sides (23) which are bevelled are in the vicinity of their inner edges.

8. Hand tool according to claim 7 wherein said sloping surfaces (25) are bevels at an angle of approximately 45°.

9. Hand tool according to claim 7, wherein said sloping surface (25) having a width which increases from its ends towards its center.

10. Hand tool according to claim 9, wherein said outer contour (16) of the gripping arms (14) between said depressions (26) and the ends (28) thereof form the shape of an ellipse or oval.

11. Hand tool according to claims, 1 or 2 wherein the cross-section through gripping arms (14) is generally rounded in an oval or elliptical manner on the outside of said gripping arms.

12. Hand tool according to claims, 1 or 2 wherein said gripping arms include grip portions of insulating plastic forming said outer contours and said sloping surfaces.

* * * * *